United States Patent [19]

Brown et al.

[11] 4,026,538

[45] May 31, 1977

[54] SHEET PUSHER

[75] Inventors: Michael A. Brown, Norwalk; Hans C. Mol, Wilton, both of Conn.

[73] Assignee: Pitney-Bowes, Inc., Stamford, Conn.

[22] Filed: Apr. 12, 1976

[21] Appl. No.: 675,911

[52] U.S. Cl. ..... 271/42

[51] Int. Cl.[2] ..... B65H 3/24

[58] Field of Search ..... 271/42, 128, 129, 130; 270/58; 74/575, 576; 192/55

[56] References Cited

UNITED STATES PATENTS

| | | | |
|---|---|---|---|
| 946,347 | 1/1910 | Giroud | 271/128 |
| 1,087,533 | 2/1914 | Freeman | 271/130 X |
| 1,600,088 | 9/1926 | Burstyn | 74/575 |
| 2,093,384 | 9/1937 | Storck | 271/42 |
| 2,196,189 | 4/1940 | Bott | 74/575 |
| 3,152,801 | 10/1964 | Quinn | 270/58 |
| 3,257,794 | 6/1966 | Bennett | 74/575 X |

*Primary Examiner*—Richard A. Schacher
*Attorney, Agent, or Firm*—Martin D. Wittstein; William D. Soltow, Jr.; Albert W. Scribner

[57] ABSTRACT

A reciprocating sheet pusher for ejecting a topmost sheet of a stack of sheets outward seriatim from a sheet receiving bin having sheet ejecting support structure attached to a pusher arm which carries a roller ejecting element. A piece of stiff firm hair material affixed to the support structure clutches with controlled predetermined friction the axially supported rubber roller to resist movement on a forward sheet ejecting stroke of the reciprocating sheet pusher. If a predetermined resistance against a jammed sheet or an empty bin is encountered, the roller ejecting element rotates with limited controlled friction. The roller ejecting element rotates unrestrained when the sheet pusher moves in an opposite direction to that of ejecting a sheet.

6 Claims, 4 Drawing Figures

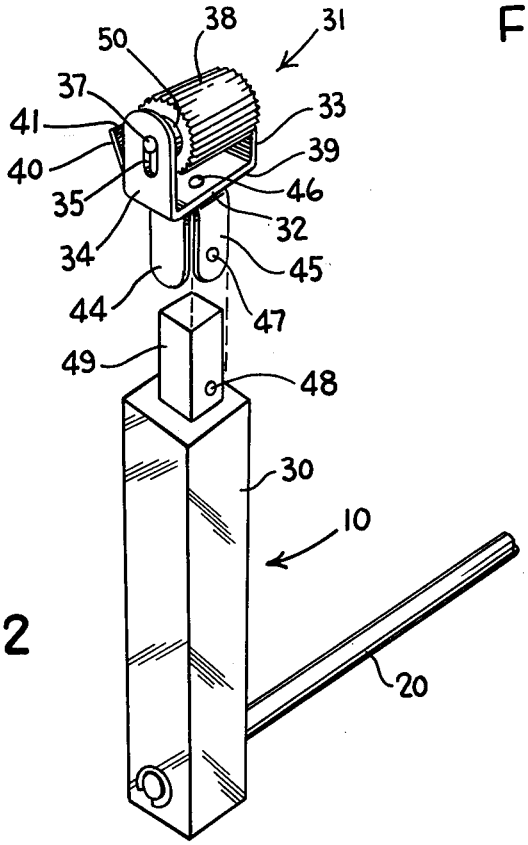
FIG. 2
FIG. 3
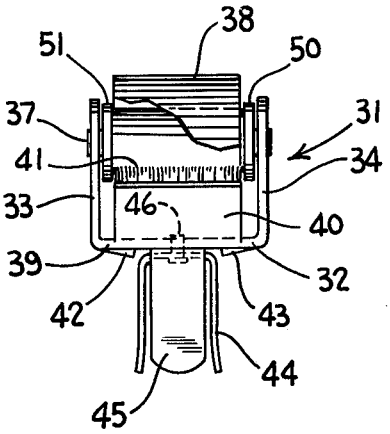
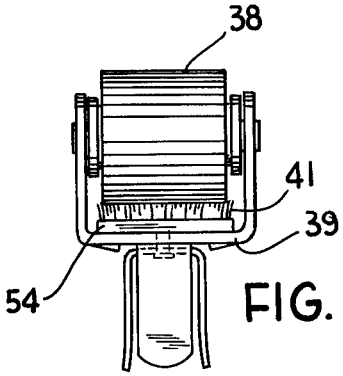
FIG. 4
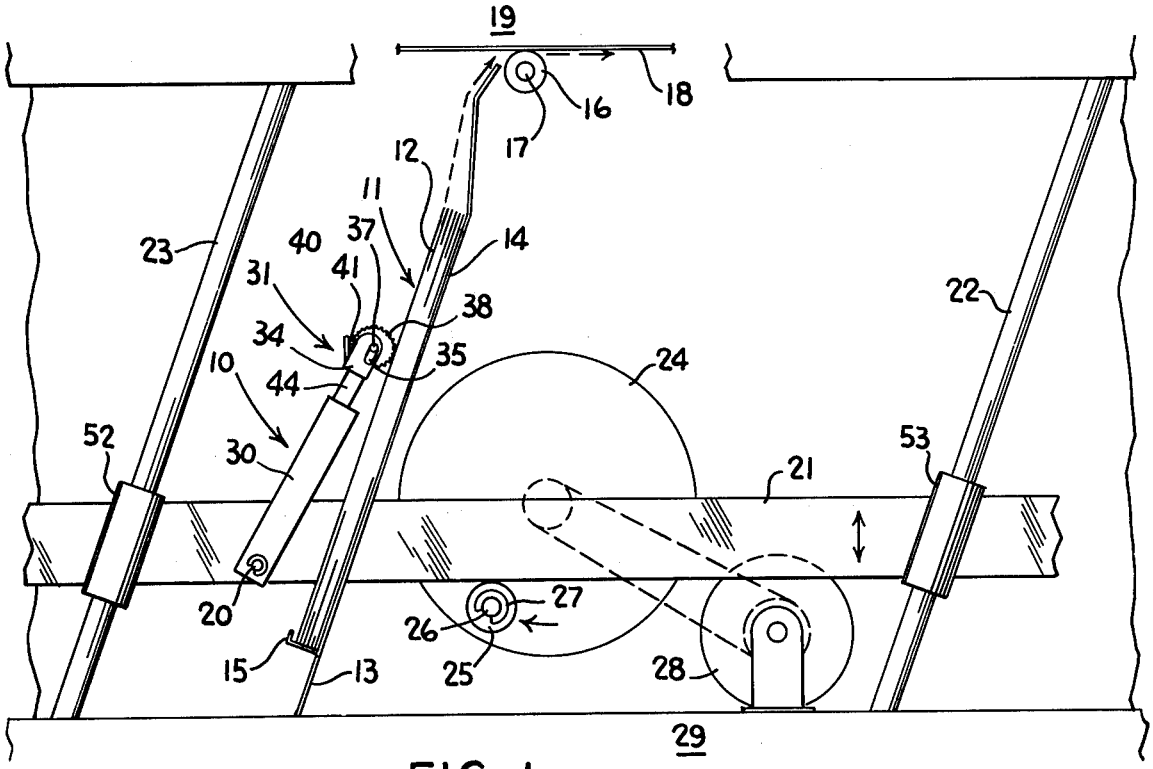
FIG. 1

SHEET PUSHER

BACKGROUND OF THE INVENTION

1. Field of the Invention

The present invention relates to a reciprocating sheet pusher for sheet feeding or delivering a topmost sheet seriatimly from a stack of sheets ejected from a sheet receiving storage bin.

2. Description of the Prior Art

In the field of sheet feeding or delivering, it has been a general practice to seriatimly eject sheets from sheet receiving storage bins, such as in a collator. Mechanical structure necessary to eject a topmost sheet from a stack of sheets is usually complex and cumbersome in addition to being less than satisfactory in ejecting one sheet at a time.

Sheet feeders which push paper despite such inherent difficulties as pushing more than one sheet at a time are known and used in the art taking many forms of construction.

Mestre, U.S. Pat. No. 3,208,746; issued Sept. 28, 1965, discloses a sheet feeding arm pivotally mounted at one end and a pair of rotating sheet feed rolls at the other end. The sheet feed rolls are carried on sleeves which are releasably anchored to roll shafts. A drive system is provided between the pivot shaft and roll shaft so that when the roll shaft is rotated, sheet feed rolls push a sheet forward and outward away from a pile of sheets carried by the sheet bin. As the pusher arm doesn't reciprocate, this prior art does not directly relate to the invention.

Another prior art device uses an inclined sheet receiving bin having a conventional sheet pusher arm which locks a first roller against movement in a push direction and rolls in a reverse direction. A second roller mounted on the sheet pusher arm rolls in a groove in the sheet receiving bin which eliminates any problem of a locked roller jamming in the bin on a sheet mis-feed or where there are no sheets in the bin is the sheet pusher arm partially falls into the groove. The second roller rides on the bin supporting the first roller within the groove. This prior art device requires a special design of sheet receiving storage bin in combination with the special requirements of the sheet pusher arm. The present invention can be used with any sheet receiving storage bin.

Other prior art devices using sheet pusher arms to eject sheet seriatim out of a sheet receiving storage bins are U.S. Pat. Nos. 3,669,442 issued June 16, 1972; and 3,891,202 issued June 24, 1975. These patents disclose ejection feet which do not relate to the present invention.

SUMMARY

The general purpose of this invention is to provide a sheet pusher to eject sheets outward from a sheet receiving storage bin wherein the sheet ejecting element is frictionally controlled with limited resistance against the pushed sheet.

The sheet pusher, hereinafter also referred to as a sheet ejector, operates reciprocally against the topmost sheet of a stack of sheets to eject sheets seriatim through a rotatably mounted sheet ejecting element. The sheet ejecting element is an axially supported grooved rubber roller. A piece of material having stiff firm hair affixed to the support for the roller acts as a clutch to resist rotation of the roller in the sheet ejecting direction, but permits limited controlled rotation of the sheet ejecting element when a predetermined limited resistance of rotation exerted the material is overcome. The sheet ejecting roller element is permitted to rotate unrestrained as it moves in the opposite direction completing its reciprocating cycle.

An object of the present invention is to provide a sheet pusher which will not possibly jam its actuating structure while it moves the sheet pusher to eject a sheet.

Another object is to provide a sheet pusher which is economical in cost, non-complex in design and construction, and simple in operation to push all weights of paper from onion skin to heavy rag content.

A further object of the invention is to provide of a sheet pusher having a sheet ejecting element, a roller in this instance, responsive to different coefficients of friction between the sheet ejecting element and the material it clutches into engagement with to prevent jamming of the actuating mechanism.

Still another object is to provide a sheet pusher which will roll in an empty sheet receiving storage bin which does not contain any sheets. The sheet ejecting roller element will roll with limited controlled friction against the back of the bin and not jam the actuating mechanism.

BRIEF DESCRIPTION OF THE DRAWING

Other objects and many of the attendant advantages of this invention will be readily appreciated as the same becomes better understood by reference to the following detailed description when considered in connection with the accompanying drawings, in which like reference numerals designate like parts throughout the figures thereof and wherein:

FIG. 1 illustrates a reciprocating sheet pusher, the invention, in its intended use;

FIG. 2 illustrates an exploded perspective of the sheet pusher where the pusher arm is separated from roller support structure;

FIG. 3 illustrates a back cutaway view of support structure of the invention; and FIG. 4 illustrates another preferred embodiment of the invention.

DESCRIPTION OF THE PREFERRED EMBODIMENTS

FIG. 1 illustrates a preferred embodiment of a sheet pusher 10 in its intended use to push a topmost sheet 11 of a stack of sheets 12 outward seriatim of a sheet receiving storage bin 13 into for example, a sheet conveyor system. Sheet receiving storage bin 13 may be aluminum for example having a back member 14 for sheets to rest against and a bottom member 15 for bottom edges of sheets 12 to abut against into registration through gravity. Sheet receiving storage bin 13 may comprise one of a plurality of vertical in line slanted storage bins affixed to a housing frame of, for example, a collator machine. Roller 16 mounted on shaft 17 along with a driven belt 18 form a sheet conveyor system 19 which is shown only partially in section for purposes of illustration. The drive system for moving belt 18 of sheet conveyor system 19 is not disclosed as such systems are known in the art. Sheet pusher 10 at one end is rotatably attached to a rod 20 by any suitable means such as an E washer. Rod 20 is securely affixed to and carried by cam bar 21. Cam bar 21, for example if used in a sheet feeding or collator machine, may carry in line a plurality of rods 20 and an equal number of sheet pushers 10 for respective sheet receiving bins 13. Cam bar 21 with bearings 52 and 53 is slidably reciprocated on rods 22 and 23 through rotating action of cam 24 and roller 25. Roller 25 rotates freely on a shaft 26 fixedly attached to cam 24. Roller 25 is secured to shaft 26 by an E washer 27. Cam 24 is driven by a slow speed motor 28 through a drive belt. Sheet receiving bin 13, rods 22 and 23, and motor 28 are all securely mounted to a housing frame 29. Sheet pusher 10 which is now described in more detail consists of a pusher arm 30 rotatably attached to rod 20 with support structure 31 releasably mounted to pusher arm 30.

FIG. 2 shows an exploded perspective view of sheet pusher 10 with pusher arm 30 being separated from sheet ejecting support structure 31. Support structure 31 is formed by a U-shaped bracket 32 having opposite vertical members 33 and 34 interconnected by a horizontal member 39. Opposite vertical members 33 and 34 have oblong holes 35 and 36 (not shown) which are offset to one side of vertical members 33 and 34. A shaft 37 is axially supported to rotate in oblong holes 35 and 36. The diameter of shaft 37 is determined by the width of offset oblong holes 35 and 36 and is chosen to be slightly smaller than the width so that shaft 37 will rotate freely. An ejecting element 38, in this instance a roller, slides over shaft 37 prior to the mounting of shaft 37 in sheet ejecting support structure 31. Roller 38 may be made of any suitable material such as soft pliable rubber which further enhances gripping of a sheet 11 on an upward pushing stroke. Roller 38 can be appropriately grooved longitudinally as illustrated in FIGS. 2 and 3. The inner diameter of roller 38 is chosen to slide over shaft 37. The portion of shaft 37 which is in between vertical members 33 and 34 can be larger than that which fits into oblong holes 35 and 36 to accommodate any inner diameter of roller 38. The outer diameter of roller 38 offset in oblong holes 35 and 36 determines what distance roller 38 overhangs the outside perimeter of roller support structure 31. Further, shaft 37 can have retaining flanges 50 and 51 to contain the sides of roller 38 as shown in FIG. 3 being spaced from opposite vertical members 33 and 34 so as to eliminate radial play of rubber roller 38. The width of roller 38 is slightly smaller than the distance between opposite vertical member 33 and 34 so as not to bind as is likewise the distance between retaining flanges on shaft 37 as shown in FIG. 3. Interconnecting horizontal member 39 of U-shaped member 32 has a bracket 40 extending obliquely outward and away from horizontal member 39. A piece of material 41 such as cloth or carpet is suitably attached such as by glue to bracket 40. Material 41 should have stiff firm hairs to bias against roller 38. When a top sheet 11 is being pushed during an upward stroke of its reciprocation, roller 38 is clutched against rotation by being biased against firm hair material 41. Roller 38 is not allowed to rotate on its upward stroke while pushing sheets as the roller, or in this instance, the grooves, are held against rotation of shift bristle hairs of material 41. Roller 38, if sheet storing bin 13 is empty will be permitted to rotate with limited resistance against empty bin 13 with controlled friction through roller 38 being biased against the firm hair material 41. A suitable material 41 by and for way of example only has been found to be carpet manufactured under the trademark name Astro-Turf.

FIG. 3 illustrates a back cutaway view of support structure 31. Particularly, shaft 37 is shown in detail with projecting flanges 50 and 51 on opposing sides of roller 38. Shaft 37 varies in diameter to rotate in offset oblong holes 35 and 36, and accommodate cutaway roller 38. Interconnecting horizontal member 39 has downward limit projections 42 and 43 extending outward and away from U-shaped bracket 32. Two spring U-shaped members 44 and 45 perpendicularly positioned to each other, and mounted one over the other are rotatably axially connected to interconnecting horizontal member 39 by a rivet 46. Rivet 46 allows a limited degree of swivel between interconnecting horizontal member 39, and spring U-shaped members 44 and 45. An outward projection 47 in a lower portion of spring U-shaped member 44 fits into an indentation 48 in FIG. 2 of rectangular extension member 49 of pusher arm 30. Support 31 slidably mounts over extension member 49 of arm 30 wherein outward projection 47 on spring U-shaped member 44 engages indentation 48 of extension member 49 to form sheet pusher 10.

In an alternative arrangement, support assembly 31 can be permanently attached directly to extension member 49 of pusher arm 30 through rivet 46 thereby eliminating spring U-shaped members 44 and 45, outward projection 47, and indentation 48. Although easy replaceability feature of removing roller support structure 31 via spring U-shaped member 44 and 45 is thereby eliminated.

FIG. 4 illustrates another preferred embodiment of the invention where material 41 attached to backing 54 is affixed to interconnecting horizontal member 39. All other elements correspond to their respective numerals as shown in FIG. 3. This eliminates bracket 40. As roller 38 carried shaft 37 moves downwardly on an upward sheet pushing stroke, roller 38 is clutched by firm hair material 41 which biases against roller 38 to resist movement or limit any movement with controlled friction.

Preferred Mode of Operation

In operation and making reference to FIGS. 1 to 3, especially to FIG. 1, sheet pusher 30 travels in a reciprocating upward and downward path lengthwise along the stack of sheets 12 through motion transferred by reciprocating cam bar 21 to rod 20. A slow speed motor 28 circularly rotates cam 24 through a drive belt resulting in cam bar 21 riding on roller 25 axially held onto shaft 26 by E washer 27 where shaft 26 is fixedly secured to cam 24. Shaft 26 of roller 25 prescribes a circular orbital path through circular rotation of cam 24 causing shaft 26 to travel from a high point to a low point on cam 24 accordingly with cam bar 21 sliding up and down on rods 22 and 23 while riding on a top portion of rotating roller 25. As cam bar 21 slides upward on rods 22 and 23 from motion of roller 25, motion is transferred to sheet pusher 30 through rod 20 causing ejecting roller 38 to bias against top sheet 11.

As the roller 38 biases against top sheet 11 and sheet pusher 30 begins to move on its upward stroke, roller 38 carried by shaft 37 is forced downwardly in oblong holes 35 and 36 forcing roller 38 and if grooved, any grooves, to be biased against material 41 carried by bracket 40 thereby clutching roller 38 preventing rotation. This clutching action of non-rotation of roller 38 as shown in FIG. 3 prevents movement of roller 38 against top sheet 11. The operation of FIG. 4 is identical in theory to that of FIG. 3 where instead of roller 38 being clutched against stiff firm hair material 41 carried by bracket 40 in FIG. 3, roller 38 is clutched against rotation by the stiff firm hairs of material 41 attached to backing 54 carried by interconnecting horizontal member 39 as shown in FIG. 4. Top sheet 11 is then pushed outward to be ejected from a sheet receiving storage bin 11 by non-rotating clutched roller 38 on the upward stroke of sheet pusher 30. Sheet pusher 30 will eject sheets from either a vertical bin as disclosed, a horizontal bin, or a bin having a slant therebetween. Clutched roller 38, unable to rotate, acts and in theory, acts as a firm rubber stop pushing top sheet 11 upward. Pushed top sheet 11 is fed upward into the nip of roller 16 and belt 18. At the top of upward stroke of reciprocating sheet pusher 30, sheet 11 is now pulled into a conveyor system 19 by action of moving belt 18 against roller 16 and is no longer pushed by sheet pusher 30. If the top most sheet 11 were to jam, roller 38, locked against rotation by the stiff firm hairs of material 41, would overcome a predetermined resistive force according to the qualities of material used, and begin to rotate against the limited resistance offered by material 41. Roller 38 would no longer be clutched against material 41, but would rotate against material 41 with limited resistance. The same argument, in theory, applies to roller 38 rotating against an empty bin 11 wherein roller 38, having overcome a predetermined resistive force of material 41, will rotate with limited resistance against the empty bins so as not to jam the actuating mechanism. On the downward stroke of sheet pusher 30, roller 38 carried on shaft 37 is forced upwardly so as to rotate unrestrained freely in oblong holes 35 and 36 by the pull of roller 38 on the next top sheet 11 and is no longer clutched by being biased against material 41. Roller 38 rotates freely against the next top sheet 11 to be fed on its downward stroke as cam bar 21 and attached structure drops on slide rods 22 and 23 by the force of gravity against roller 25. Support structure 31 on its upward or downward stroke is free to pivot to a limited degree between limit projections 42 and 43 for any variances in top sheet 11 or stack of sheets 12. The sheet pushing ejection cycle continually repeats itself as cam bar 21 rides up and down on roller 25 imparting reciprocating motion to sheet pusher 30. Sheet pusher 30 remains biased against the stack of sheets 12 through gravity due to a degree of slant of storage bin 13 as it axially rides on rod 20.

It should be appreciated that sheet pusher 30 of this invention as heretofore described will find application in virtually any sheet feeding or delivering apparatus, and should not be limited to a collator as described by way of the previous embodiment. Thus, it is seen that there is provided a sheet pusher which achieves the various objects of the invention.

Various modifications are contemplated and may obviously be resorted to by those skilled in the art without departing from the spirit and scope of the invention, as hereinafter defined by the appended claims.

Having thus described the invention, there is claimed as new and desired to be secured by Letters Patent:

1. A sheet pusher comprising a supporting member, an ejection roller carried by said supporting member, means mounting said ejection roller for rotary and reciprocable movement with respect to said supporting member, means attached to said supporting member and defining a surface disposed adjacent to the peripheral surface of said ejection roller and at an angle to the direction of reciprocable movement of said ejection roller, and material attached to said supporting surface to bias against said ejection roller with varying resistive force whereby said material forcibly restrains rotation of said roller when said sheet pusher is pushing a sheet while said ejection roller is adjacent one end of its reciprocable movement, provides limited rotation when a jammed sheet or an empty sheet supporting bin is encountered by said sheet pusher, and allows unrestrained free rotation of said ejection roller when said sheet pusher is moving in an opposite direction to said ejection direction while said ejection roller is at the other end of its reciprocable movement.

2. A sheet pusher of claim 1 wherein said mounting means comprises corresponding slots in said supporting member whereby said ejection roller axially rotates and reciprocally moves with respect to said supporting member.

3. A sheet pusher of claim 2 wherein said supporting member comprises a U-shaped member wherein said slot is in each leg of said U-shaped member.

4. A sheet pusher of claim 1 wherein said material comprises stiff firm hair material.

5. A sheet pusher of claim 1 wherein said material comprises Astro-Turf.

6. A sheet pusher of claim 1 wherein said ejection roller comprises a soft pliable grooved rubber roller.

* * * * *